United States Patent [19]

Stolka et al.

[11] Patent Number: 4,588,666

[45] Date of Patent: May 13, 1986

[54] PHOTOCONDUCTIVE IMAGING MEMBERS WITH ALKOXY AMINE CHARGE TRANSPORT MOLECULES

[75] Inventors: Milan Stolka, Fairport; Kathleen M. McGrane, Rochester; John S. Facci, Webster, all of N.Y.

[73] Assignee: Xerox Corporation, Stamford, Conn.

[21] Appl. No.: 748,079

[22] Filed: Jun. 24, 1985

[51] Int. Cl.[4] ..... G03G 5/14

[52] U.S. Cl. ..... 430/59; 430/96; 564/309

[58] Field of Search ..... 430/59, 58, 66

[56] References Cited

U.S. PATENT DOCUMENTS

| | | | |
|---|---|---|---|
| 4,265,990 | 5/1981 | Stolka et al. | 430/59 |
| 4,346,158 | 8/1982 | Pai et al. | 430/59 |
| 4,378,415 | 3/1983 | Chu | 430/45 |
| 4,397,931 | 8/1983 | Limburg et al. | 430/59 |
| 4,489,148 | 12/1984 | Horgan | 430/59 |

*Primary Examiner*—John L. Goodrow

*Attorney, Agent, or Firm*—E. O. Palazzo

[57] ABSTRACT

Disclosed is a hole transporting molecule comprised of alkoxy derivatives of tetra phenyl biphenyl diamine of the following formula:

wherein $R_1$ is independently selected from the group consisting of hydrogen, ortho alkoxy, meta alkoxy, para alkoxy, ortho alkyl, meta alkyl, para alkyl, 3,5-dialkoxy, 2,4-dialkoxy, and 2,5-dialkoxy; and $R_2$ is selected from the group consisting of ortho alkoxy, meta alkoxy, para alkoxy, 3,5-dialkoxy, 2,4-dialkoxy, and 2,5-dialkoxy; and layered imaging member containing therein the aforementioned alkoxydiamine derivatives and a photoconductive layer.

24 Claims, 1 Drawing Figure

PHOTOCONDUCTIVE IMAGING MEMBERS WITH ALKOXY AMINE CHARGE TRANSPORT MOLECULES

BACKGROUND OF THE INVENTION

This invention is generally directed to charge transporting molecules, and more specifically the present invention is directed to imaging members having incorporated therein as charge transporting layers certain derivatives of arylamines. Thus, in one embodiment the present invention envisions layered photoresponsive imaging members comprised of a photogenerating layer and a charge transport layer having incorporated therein alkoxy derivatives of the tetraphenyl biphenyl diamines described in U.S. Pat. No. 4,265,990, the disclosure of which is totally incorporated herein by reference. Layered imaging members with the aforementioned alkoxy diamine transport molecules are useful in electrostatographic imaging systems, particularly xerographic imaging processes. Furthermore, the alkoxy derivatives of the tetraphenyl biphenyl diamines have desirable improved properties with regard to the parent tetraphenyl diamines inclusive of higher charge carrier mobilities, and increased solubility in inactive resinous binders.

Layered imaging members with charge transport molecules are disclosed in a number of prior art references inclusive of U.S. Pat. No. 4,265,990. These imaging members are generally comprised of supporting substrates, a photoconductive layer containing photogenerating pigments therein, and as a charge transport layer arylamines inclusive of alkyl, chloro substituted biphenyl, and chloro substituted tetraphenyl diamine transport molecules. One specific charge transport molecule disclosed in the prior art is N,N'-diphenyl-N,N'-bis(3-methylphenyl)-[4,4'-biphenyl]-1,1'-diamine. The charge transport molecules of the present invention which are derivatives of the aforementioned arylamines exhibit higher charge carrier mobilities and increased solubility in resin binders. Increased carrier movement enables a desirable reduction in the concentration or amount of alkoxy amine transport molecule while simultaneously maintaining the high mobilities thereof required in the imaging member selected. Additionally, the use of decreased amounts of alkoxy transport molecule provides for an improvement in the mechanical characteristics of the resulting transport layers. These characteristics and other properties associated with the alkoxy arylamine transport molecules of the present invention permit the use of a number of different resinous binders, and allow the resulting imaging member to be useful for numerous imaging cycles at high process speeds; and wherein there is maintained high charge mobility in the charge transporting layers.

Also known are layered imaging members with polysilylene hole transporting molecules, reference copending application U.S. Ser. No. 694,862, entitled Photoresponsive Imaging Members with Polysilylenes Hole Transporting Compositions, the disclosure of which is totally incorporated herein by reference.

Many other patents disclose layered photoresponsive imaging members such as U.S. Pat. No. 3,041,167, which illustrates an overcoated member comprised of a conductive substrate, a photoconductive layer, and an overcoating layer of an electrically insulating polymeric material. This member can be utilized in an electrophotographic copying method by, for example, initially charging with an electrostatic charge of a first polarity, and imagewise exposing to form an electrostatic latent image which can be subsequently developed. Prior to each succeeding cycle, the imaging member can be charged with an electrostatic charge of a second polarity, which is opposite in polarity to the first polarity. Sufficient additional charges of the second polarity are applied creating across the member a net electrical field of the second polarity. Simultaneously, mobile charges of the first polarity are created in the photoconductive layer by applying an electrical potential to the conductive substrate. The imaging potential which is developed to form the visible imaging is present across the photoconductive layer and the overcoating layer.

Further, there is disclosed in Belgian Patent No. 763,540, an electrophotographic member having at least two electrically operative layers. The first layer is comprised of a photogenerating substance which injects carriers into a continuous active layer containing an organic transporting material which is substantially non-absorbing in the spectral region of intended use. Additionally, there is disclosed in U.S. Pat. No. 3,041,116, a photoconductive material containing a transparent plastic material overcoated on a layer of vitreous selenium contained on a substrate.

Furthermore, there is disclosed in U.S. Pat. Nos. 4,232,102 and 4,233,383, photoresponsive imaging members comprised of trigonal selenium doped with sodium carbonate, sodium selenite, and trigonal selenium doped with barium carbonate, and barium selenite or mixtures thereof. The disclosure of each of the aforementioned patents are totally incorporated herein by reference.

Additionally, the use of squaraine pigments in photoresponsive imaging members is known, reference U.S. Pat. No. 4,415,639 or other squaraine compositions, reference U.S. Pat. No. 4,471,041. The disclosure of each of the aforementioned patents are totally incorporated herein by reference. Also, as photogenerating pigments there can be selected metal phthalocyanines, metal free phthalocyanines, vanadyl phthalocyanines, selenium and selenium alloys; and perylene dyes, reference copending application U.S. Ser. No. 587,483, the disclosure of which is totally incorporated herein by reference.

While the above-described photoresponsive imaging members are suitable for their intended purposes, there continues to be a need for the development of improved members with new charge transporting molecules. Additionally, there continues to be a need for imaging members with charge transport molecules exhibiting desirable high charge carrier mobilities. Further, there is a need for imaging members with new charge transport molecules with increased solubility in resinous binder compositions. Furthermore, there continues to be a need for layered imaging members with charge transport molecules comprised of certain derivatives of tetraphenyl biphenyl diamines, and wherein the resulting members can be repeatedly used a number of imaging cycles without deterioration thereof from the machine environment or surrounding conditions. Moreover, there continues to be a need for improved layered imaging members wherein the material selected for the respective layers are substantially inert to users of such members. Also, there is a need for charge transporting layers wherein lower concentrations of the molecules present therein can be selected.

SUMMARY OF THE INVENTION

It is thus an object of the present invention to provide hole transporting molecules.

It is another object of the present invention to provide improved photoresponsive imaging members having incorporated therein as charge transporting molecules derivatives of tetraphenyl biphenyl diamines.

A further specific object of the present invention resides in the provision of an improved layered photoresponsive imaging member comprised of a photoconductive layer, and alkoxy derivatives of tetraphenyl biphenyl diamines as hole transporting molecules.

In another object of the present invention there are provided layered photoresponsive imaging members comprised of a photogenerating layer situated between a hole transport layer comprised of alkoxy derivatives of tetraphenyl biphenyl diamine, and a supporting substrate.

It is yet another object of the present invention to provide improved layered photoresponsive imaging members wherein the hole transport layer is situated between a photogenerating layer and a supporting substrate.

Also, in another object of the present invention there are provided imaging methods with the layered photoresponsive devices illustrated herein.

In still another object of the present invention there are provided improved alkoxy tetraphenyl biphenyl diamine hole transport molecules which simultaneously possess increased charge carrier mobilities, and excellent solubility in certain resinous binders.

These and other objects of the present invention are accomplished by the provision of alkoxy tetraphenyl biphenyl diamine hole transport molecules of the following formula:

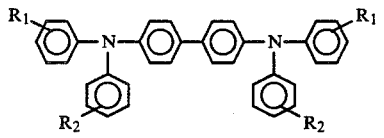

wherein $R_1$ is selected from the group consisting of hydrogen, ortho alkoxy, meta alkoxy, para alkoxy, ortho alkyl, meta alkyl, para alkyl, 3,5-dialkoxy, 2,4-dialkoxy, and 2,5-dialkoxy; and $R_2$ is selected from the group consisting of ortho alkoxy, meta alkoxy, para alkoxy, 3,5-dialkoxy, 2,4-dialkoxy and 2,5-dialkoxy. Alkyl substituents include those of from about 1 to about 20 carbon atoms, such as methyl, ethyl, propyl, butyl, pentyl, hexyl, nonyl, petadecyl, and eicosyl. Preferred alkyl groups are those of from 1 to about 6 carbon atoms inclusive of methyl, ethyl, propyl, and butyl. Similarly, alkoxy groups encompass from about 1 to about 20 carbon atoms inclusive of methoxy, ethoxy, propoxy, butoxy, pentoxy, hexoxy, pentaoxy, and other similar alkoxy substituents. Particularly preferred alkoxy groups are those of from about 1 to 6 carbon atoms such as methoxy, ethoxy, propoxy and butoxy. These alkoxy amine hole transport compounds can be prepared as illustrated, for example, by the Ullmann reaction described in the Journal of Organic Chemistry, Vol. 37, No. 26, page 4440, 1972, S. C. Creason, J. Wheeler, and R. F. Nelson, the disclosure thereof being totally incorporated herein by reference.

Illustrative examples of charge transport molecules included within the present invention are N,N'-diphenyl-N,N'-bis(4-methoxyphenyl)-[4,4'-biphenyl]-1,1'-diamine; N,N'-diphenyl-N,N'-bis(4-ethoxyphenyl)-[4,4'-biphenyl]-1,1'-diamine; N,N'-diphenyl-N,N'-bis(4-propoxyphenyl)-[4,4'-biphenyl]-1,1'-diamine; N,N'-diphenyl-N,N'-bis(4-butoxyphenyl)-[4,4'-biphenyl]-1,1'-diamine; N,N'-diphenyl-N,N'-bis(4-pentoxyphenyl)-[4,4'-biphenyl]-1,1'-diamine; N,N'-diphenyl-N,N'-bis(3,5-dimethoxyphenyl)-[4,4'-biphenyl]-1,1'-diamine; N,N'-diphenyl-N,N'-bis(2,4-dimethoxyphenyl)-[4,4'-biphenyl]-1,1'-diamine; and N,N'-diphenyl-N,N'-bis(2,5-dimethoxyphenyl)-[4,4'-biphenyl]-1,1'-diamine.

The alkoxy tetraphenyl biphenyl diamine hole transport molecules of the present invention are superior in some respects to the closely related charge transport molecules as disclosed in U.S. Pat. No. 4,265,990. Thus, for example, the methoxy tetraphenyl biphenyl diamine hole charge transport molecules of the present invention have charge carrier mobilities of from about 5 to about 7 times greater than the diamine hole transport molecules of the '990 patent. Additionally, the charge transport molecules of the present invention are about two times more soluble in various binders than the charge transport molecules of the '990 patent.

Increased charge carrier mobility and higher solubilities for the alkoxy hole transport molecules of the present invention permit a lower concentration of these molecules to be selected for dispersion in polymeric binders. Additionally, increased solubility of the alkoxy hole transport molecules enable the selection of a variety of resinous binders, in addition to polycarbonates, inclusive of bisphenol A—polyester carbonate copolymers; esterified bisphenol A phenoxy resins; and epoxy resins.

The improved imaging members of the present invention can be prepared by a number of known methods, the process parameters for the coating of layers being dependent on the member desired. Thus, for example, the improved photoresponsive imaging members of the present invention can be prepared by providing a conductive substrate with an optional hole injection blocking layer and an optional adhesive layer, and applying thereto by solvent coating processes, laminating processes, or vacuum evaporation techniques, a photoconductive layer, and a hole transport layer. Other methods include melt extrusion, dip coating and spraying.

BRIEF DESCRIPTION OF THE DRAWINGS

For a better understanding of the present invention and further features, reference is made to the following detailed description of various preferred embodiments wherein.

DESCRIPTION OF THE PREFERRED EMBODIMENTS

Figure 1:
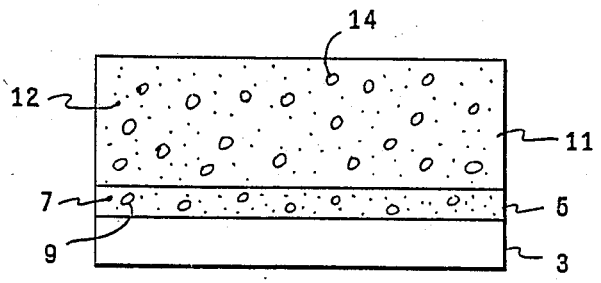
FIG. 1 is a partial schematic cross-sectional view of the improved photoresponsive imaging member of the present invention.

Illustrated in FIG. 1 is a negatively charged improved photoresponsive imaging member of the present invention comprising a supporting substrate 3, a charge carrier generation layer 5, comprised of a photogenerating pigment 7, optionally dispersed in an inactive resinous binder composition 9, and a hole transport layer 11, comprised of N,N-diphenyl-N,N'-bis(4-methoxyphenyl)-[4,4'-biphenyl]-1,1'-diamine 12, dispersed in an inactive resinous binder 14.

Figure 2:
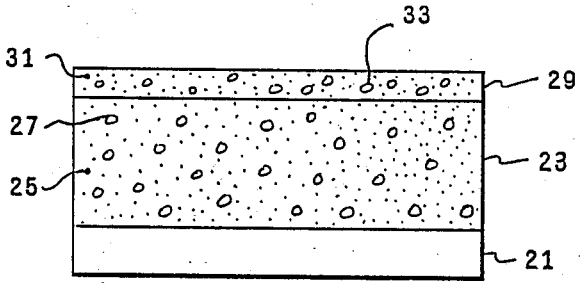
FIG. 2 represents a partial schematic cross-sectional view of a second photoresponsive imaging member of the present invention.

Illustrated in FIG. 2 is a positively charged photoresponsive imaging member of the present invention comprised of a conductive supporting substrate 21, of aluminized Mylar, a charge transport layer 23, comprised of N,N-diphenyl-N,N'-bis(4-methoxyphenyl)-[4,4'-biphenyl]-1,1'-diamine 25, dispersed in a polycarbonate resinous binder 27, and a charge carrier generation layer 29, comprised of trigonal selenium 31 optionally dispersed in an inactive resinous binder 33.

Figure 3:
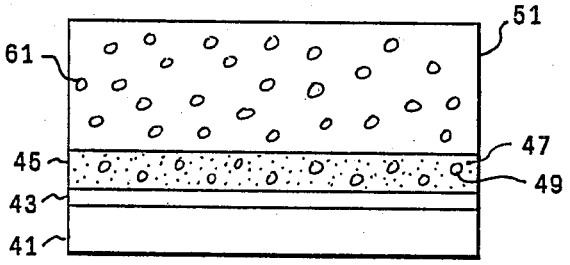
FIG. 3 represents a partial schematic cross-sectional view of the photoresponsive imaging member of the present invention including therein an adhesive blocking layer.

Illustrated in FIG. 3 is a negatively charged photoresponsive imaging member of the present invention comprised of a conductive supporting substrate 41 of aluminized Mylar, an optional adhesive blocking layer 43, a charge carrier generation layer 45, comprised of a trigonal selenium photogenerating pigment 47, or other similar inorganic pigments, dispersed in a resinous binder 49, and a hole transport layer 51, comprised of N,N-diphenyl-N,N'-bis(4-methoxyphenyl)-[4,4'-biphenyl]-1,1'-diamine, dispersed in a polycarbonate resinous binder 61.

The substrate layers may be opaque or substantially transparent and may comprise any suitable material having the requisite mechanical properties. Thus, these substrates may comprise a layer of non-conducting material, such as an inorganic or organic polymeric material, a layer of an organic or inorganic material having a conductive surface layer arranged thereon or a conductive material such as, for example, aluminum, chromium, nickel, indium, tin oxide, brass or the like. The substrate may be flexible or rigid and may have any of many different configurations such as, for example, a plate, a cylindrical drum, a scroll, an endless flexible belt and the like. Preferably, the substrate is in the form of an endless flexible belt.

Substrate layer thickness depends on many factors including economical considerations. Thus, this layer may be of substantial thickness, for example over 100 mils, or of minimum thickness the objectives of the present invention are achieved. In one preferred embodiment the thickness of this layer is from about 3 mils to about 10 mils.

Examples of the photogenerating pigments are as illustrated herein, inclusive of amorphous selenium, selenium alloys, such as $As_2Se_3$, trigonal selenium, perylenes, metal free phthalocyanines, metal phthalocyanines, vanadyl phthalocyanines, squaraines, and the like, with $As_2Se_3$ being preferred. Typically, the charge carrier photogenerating layer is of a thickness of from about 0.05 micron to about 10 microns or more, however, dependent on the photogenerating pigment volume loading which may vary from 5 to 100 volume percent, this layer can be of other thicknesses. Preferably, the photogenerating layer is of a thickness of from about 0.1 micron to about 3 microns. Generally, it is desirable to provide this layer in a thickness which is sufficient to absorb about 90 percent or more of the incident radiation which is directed upon it in the imagewise exposure step. Also, the maximum thickness of this layer is dependent primarily upon facts such as mechanical considerations, for example, whether a flexible photoresponsive imaging member is desired; or the nature of the photogenerator, that is, whether the range for holes or electrons are limited.

Optional resin binders selected for the photogenerating pigments are, for example, the polymers as illustrated in U.S. Pat. No. 3,121,006, the disclosure of which is totally incorporated herein by reference, polyesters, polyvinylbutyrals, polyvinylcarbazoles, polycarbonate resins, epoxy resins, polyhydroxyether resins, and the like.

As optional hole blocking layers, there can be selected various known metal oxides, such as aluminum oxide and the like. This layer, which is of a thickness of about less than 50 Angstroms (0.005 micron), prevents hole injection from the substrate during and subsequent to charging of the imaging member. Further, there can be included in the imaging member of the present invention situated between the supporting substrate and the photogenerating layer adhesive substances, inclusive of polymeric materials such as polyesters, polyvinylbutyral, polyvinyl pyrrolidone, and hydrolyzed gamma-aminopropyl triethoxy silane, reference U.S. Pat. No. 4,464,450 issued Aug. 7, 1984, the disclosure of which is totally incorporated herein by reference.

The alkoxy amine hole transport compounds of the present invention can be prepared as illustrated, for example, by the Ullmann reaction described in the Journal of Organic Chemistry, Vol. 37, No. 26, page 4440, 1972, S. C. Creason, J. Wheeler, and R. F. Nelson, the disclosure thereof being totally incorporated herein by reference.

With further regard to the imaging members of the present invention, the charge transport layer is generally of a thickness of from about 2 microns to about 50 microns, and preferably is of a thickness of from about 5 microns to about 30 microns. Resinous binders that can be selected for dispersion of the alkoxy diamine hole transport molecules include those as described in U.S. Pat. No. 3,121,006, the disclosure of which is totally incorporated herein by reference. Specific examples of binders are polyvinylcarbazoles, polycarbonate resins, epoxy resins, polyvinylbutyrals, polyhydroxyether resins, and the like.

The invention will now be described in detail with respect to specific preferred embodiments thereof, it being understood that these examples are intended to be illustrative only as the invention is not limited to the materials, conditions, or process parameters recited. All parts and percentages are by weight unless otherwise indicated.

EXAMPLE I

There was prepared N,N'-diphenyl-N,N'-bis(4-methoxyphenyl)-[4,4'-biphenyl]-1,1'-diamine by the Ullmann reaction of 20 grams of diphenylbenzidine and 61.2 grams of 4-iodoanisole in accordance with the procedure described in the Journal of Organic Chemistry, Vol. 37, No. 26, page 4440, (1972), by S. C. Creason, J. Wheeler, and R. F. Nelson, the disclosure of this article being totally incorporated herein by reference. The crude product resulting was then admixed with hot toluene, and thereafter the toluene was evaporated at reduced pressure from the mixture. Subsequently, the product obtained was dispersed in diethyl ether permitting a crystalline precipitate to form, while residual impurities remained soluble in the diethyl ether solvent. There resulted subsequent to filtration 26 grams of product which was then dissolved in a hot mixture of 455 milliliters of acetone and 100 milliliters of benzene.

After cooling to −5° C., there resulted a crystallized product. Approximately 25 grams of the methoxydiamine product was then passed through a column with a Woelmneutral alumina and a benzene-hexane solvent, in a ratio of 1:1, to remove impurities. There were obtained, subsequent to filtration, 19 grams of the methoxy diamine product.

Other alkoxy diamines illustrated herein can be prepared in a similar manner.

EXAMPLE II

There was prepared a photoresponsive imaging member by providing an aluminized Mylar substrate in a thickness of 3 mils (75 microns), followed by applying thereto with a multiple clearance film applicator, in a wet thickness of 0.5 mils (13 microns), a layer of 3-aminopropyltriethoxysilane, available from PCR Research Chemicals of Florida, hydrolyzed first in water at a 1:50 volume ratio for 2 hours, and diluted by ethanol to a 0.1 percent solution of the silanol in water/ethanol. This layer was then allowed to dry for 5 minutes at room temperature, followed by curing for 10 minutes at 110° C. in a forced air oven. A charge carrier generation layer of trigonal selenium, 25 percent by volume, in 75 percent by volume of polyvinylcarbazole, and of a thickness of 0.4 microns was then applied by bar coating to the silane layer. Thereafter, the selenium layer was overcoated with a charge transport layer comprised of 35 percent by weight of N'N-diphenyl-N,N'-bis(4-methoxyphenyl)-[4,4'-biphenyl]-1,1'-diamine dispersed in 65 percent by weight of a polycarbonate resinous binder, available from Mobay Chemical. The charge transport layer was applied by spraying from a solution of methylene chloride. There resulted after drying a charge transport layer of a thickness of 30 microns.

Electrostatic images were then generated on the above prepared imaging member subsequent to its incorporation into a xerographic imaging test fixture, and after charging the member to a negative voltage of 1,000 volts. Thereafter, the resulting images were developed with a toner composition comprised of 92 percent by weight of a styrene n-butylmethacrylate copolymer (58/42), 8 percent by weight of carbon black particles, and 2 percent by weight of the charge enhancing additive cetyl pyridinium chloride. There will result developed images of excellent resolution, with superior quality, and no background deposits for 100,000 imaging cycles.

EXAMPLE III

A photoresponsive imaging member is prepared by repeating the procedure of Example II with the exception that there is selected 25 percent by weight of the N,N'-diphenyl-N,N'-bis(4-methoxyphenyl)-[4,4'-biphenyl]-1,1'-diamine dispersed in 75 percent by weight of the polycarbonate resinous binder. Substantially similar results are obtainable when this imaging member is incorporated into the xerographic imaging test fixture of Example II.

EXAMPLE IV

There is prepared an imaging member by repeating the procedure of Example II with the exception that there is selected for the charge carrier generation layer instead of trigonal in a binder, vacuum deposited arsenic triselenide $As_2Se_3$, 0.1 micron in thickness. Substantially similar results are obtainable when this imaging member is incorporated into the xerographic imaging test fixture of Example III.

EXAMPLE V

A photoresponsive imaging member is prepared by repeating the procedure of Example II with the exception that there is selected as the resinous binder for the charge transport molecule, in place of the polycarbonate, a bisphenol A dimethylsiloxane, available from General Electric, and obtained by the polycondensation of bisphenol A with dimethyl dichlorosilane. Substantially similar results are obtainable when this imaging member is incorporated into the xerographic imaging test fixture of Example II.

EXAMPLE VI

An imaging member is prepared by repeating the procedure of Example II with the exception that there was selected as the carrier generation layer, 0.2 micron thick, vanadyl phthalocyanine, 30 percent by weight, dispersed in 70 percent by weight of Goodyear polyester 49,000, instead of trigonal selenium in a binder. Substantially similar results are obtainable when this imaging member is incorporated into the xerographic imaging test fixture of Example II.

Although the invention has been described with reference to specific preferred embodiments, it is not intended to be limited thereto, rather those skilled in the art will recognize variations and modifications may be made therein which are within the spirit of the invention and within the scope of the following claims.

What is claimed is:

1. A hole transporting molecule for photoresponsive imaging members comprised of alkoxy derivatives of tetraphenyl biphenyl diamines of the following formula:

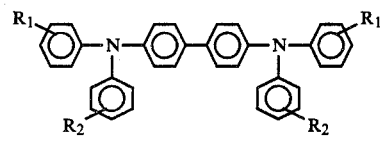

wherein $R_1$ is independently selected from the group consisting of hydrogen, ortho alkoxy, meta alkoxy, para alkoxy, ortho alkyl, meta alkyl, para alkyl, 3,5-dialkoxy, 2,4-dialkoxy, and 2,5-dialkoxy; and $R_2$ is selected from the group consisting of ortho alkoxy, meta alkoxy, para alkoxy, 3,5-dialkoxy, 2,4-dialkoxy, and 2,5-dialkoxy.

2. A hole transporting molecule in accordance with claim 1 wherein the alkyl substituents contain from 1 to about 20 carbon atoms.

3. A hole transporting molecule in accordance with claim 1 wherein the alkoxy substituents contain from 1 to about 20 carbon atoms.

4. A hole transporting molecule for photoresponsive imaging members comprised of alkoxy derivatives of tetraphenyl biphenyl diamine of the following formula:

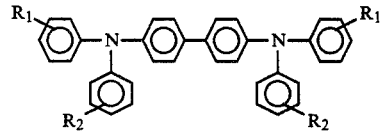

wherein $R_1$ is independently selected from the group consisting of ortho methoxy, meta methoxy, para methoxy, ortho methyl, meta methyl, para methyl, 3,5-dimethoxy, 2,4-dimethoxy, and 2,5-dimethoxy; and $R_2$ is selected from the group consisting of ortho methoxy, meta methoxy, para methoxy, 3,5-dimethoxy, 2,4-dimethoxy, and 2,5-dimethoxy.

5. The hole transporting composition N,N-diphenyl-N,N'-bis(4-methoxyphenyl)-[4,4'-biphenyl]-1,1'-diamine.

6. The hole transporting composition N,N'-diphenyl-N,N'-bis(3,5-dimethoxyphenyl)-[4,4'-biphenyl]-1,1'-diamine.

7. An improved layered photoresponsive imaging member comprised of a supporting substrate, a photogenerating layer and a charge transport layer having incorporated therein, and dispersed in a resinous binder a transporting molecule of the formula:

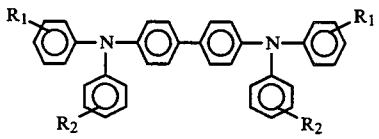

wherein $R_1$ is independently selected from the group consisting of hydrogen, ortho alkoxy, meta alkoxy, para alkoxy, ortho alkyl, meta alkyl, para alkyl, 3,5-dialkoxy, 2,4-dialkoxy, and 2,5-dialkoxy; and $R_2$ is selected from the group consisting of ortho alkoxy, meta alkoxy, para alkoxy, 3,5-dialkoxy, 2,4-dialkoxy, and 2,5-dialkoxy.

8. An improved layered photoresponsive imaging member in accordance with claim 7 wherein the alkyl substituent is from 1 to about 20 carbon atoms.

9. An improved layered photoresponsive imaging member in accordance with claim 7 wherein the alkoxy substituent is from 1 to about 20 carbon atoms.

10. An improved layered photoresponsive imaging member comprised of a supporting substrate, a photogenerating layer and a charge transport layer having incorporated therein, and dispersed in a resinous binder a transporting molecule of the formula:

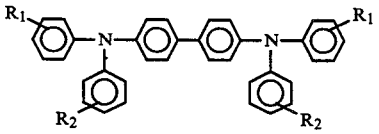

wherein $R_1$ is independently selected from the group consisting of ortho methoxy, meta methoxy, para methoxy, ortho methyl, meta methyl, para methyl, 3,5-dimethoxy, 2,4-dimethoxy, and 2,5-dimethoxy; and $R_2$ is selected from the group consisting of ortho methoxy, meta methoxy, para methoxy, 3,5-dimethoxy, 2,4-dimethoxy, and 2,5-dimethoxy.

11. An improved imaging member in accordance with claim 7 wherein the charge transporting molecule is N,N-diphenyl-N,N'-bis(4-methoxyphenyl)-[4,4'-biphenyl]-1,1-diamine, or N,N'-diphenyl-N,N'-bis(3,5-dimethoxyphenyl)-[4,4'-biphenyl[-1,1'-diamine.

12. An improved imaging member in accordance with claim 7 wherein the photogenerating layer is comprised of photogenerating pigments selected from the group consisting of metal phthalocyanines, metal free phthalocyanines, perylenes, and vanadyl phthalocyanines.

13. An improved imaging member in accordance with claim 7 wherein the photogenerating layer is comprised of inorganic photogenerating pigments selected from the group consisting of amorphous selenium, trigonal selenium, and amorphous selenium alloys.

14. An improved imaging member in accordance with claim 7 wherein a photogenerating composition is dispersed in an inactive resinous binder.

15. An improved imaging member in accordance with claim 14 wherein the photogenerating composition is dispersed in an inactive resinous binder selected from the group consisting of polycarbonates, polyesters, and polyhydroxyethers.

16. An improved imaging member in accordance with claim 7 wherein the charge transporting molecules are dispersed in an inactive resinous binder selected from the group consisting of polycarbonates, polyvinylbutyrals, and bisphenol A dimethyl siloxanes.

17. An improved imaging member in accordance with claim 7 wherein the supporting substrate is aluminum.

18. An improved imaging member in accordance with claim 10 wherein the supporting substrate is aluminum.

19. An improved layered photoresponsive imaging member consisting essentially of a supporting substrate; a photogenerating layer comprised of photogenerating pigments selected from the group consisting of selenium, selenium alloys, trigonal selenium and vanadyl phthalocyanine; and a charge transport layer comprised of the charge transporting molecules of claim 1 dispersed in an inactive resinous binder.

20. An improved layered photoresponsive imaging member consisting essentially of a supporting substrate; a photogenerating layer comprised of photogenerating pigments selected from the group consisting of selenium, selenium alloys, trigonal selenium and vanadyl phthalocyanine; and a charge transport layer comprised of the charge transporting molecules of claim 4 dispersed in an inactive resinous binder.

21. An imaging member in accordance with claim 19 wherein the charge transporting molecule is selected from the group consisting of N,N-diphenyl-N,N'-bis(4-methoxyphenyl)-[4,4'-biphenyl]-1,1-diamine, and N,N'-diphenyl-N,N'-bis(3,5-dimethoxyphenyl)-[4,4'-bisphenyl]-1,1'-diamine.

22. An imaging member in accordance with claim 20 wherein the charge transporting molecule is selected from the group consisting of N,N-diphenyl-N,N'-bis(4-methoxyphenyl)-[4,4'-biphenyl]-1,1-diamine, and N,N'-diphenyl-N,N'-bis(3,5-dimethoxyphenyl)-[4,4'-bisphenyl]-1,1'-diamine.

23. An imaging member in accordance with claim 21 wherein the photogenerating pigment is trigonal selenium.

24. An imaging member in accordance with claim 22 wherein the photogenerating pigment is trigonal selenium.

* * * * *